US010710265B2

(12) United States Patent
Snow et al.

(10) Patent No.: US 10,710,265 B2
(45) Date of Patent: Jul. 14, 2020

(54) BLADE SAVER

(71) Applicants: Heather M. Snow, Sunnyvale, CA (US); Zachary S. Snow, Sunnyvale, CA (US)

(72) Inventors: Heather M. Snow, Sunnyvale, CA (US); Zachary S. Snow, Sunnyvale, CA (US)

( * ) Notice: Subject to any disclaimer, the term of this patent is extended or adjusted under 35 U.S.C. 154(b) by 0 days.

(21) Appl. No.: 16/567,387

(22) Filed: Sep. 11, 2019

(65) Prior Publication Data

US 2020/0001489 A1 Jan. 2, 2020

Related U.S. Application Data

(60) Provisional application No. 62/794,919, filed on Jan. 21, 2019.

(51) Int. Cl.
*B26D 7/26* (2006.01)

(52) U.S. Cl.
CPC ..... *B26D 7/2621* (2013.01)

(58) Field of Classification Search
CPC .... Y10T 83/97; B26D 7/2621; B26D 7/2635; B26D 7/26; B23D 19/00
USPC ..... 30/151, 164, 329, 337, 339
See application file for complete search history.

(56) References Cited

U.S. PATENT DOCUMENTS

| | | | | |
|---|---|---|---|---|
| 4,020,550 | A * | 5/1977 | Okada | B26B 25/005 30/124 |
| 6,782,785 | B2 * | 8/2004 | Mori | B23D 35/008 83/563 |
| 2005/0028388 | A1 * | 2/2005 | Liu | B26B 25/005 30/319 |
| 2006/0150426 | A1 * | 7/2006 | Okada | B26B 25/005 30/287 |
| 2008/0010838 | A1 * | 1/2008 | Kortleven | B26B 25/005 30/319 |

* cited by examiner

*Primary Examiner* — Phong H Nguyen
(74) *Attorney, Agent, or Firm* — Steven A. Nielsen; www.NielsenPatents.com

(57) ABSTRACT

A blade saver 100 may be used as a blade holder to repurpose and safely hold circular blades that have been previously dulled by cutting fabric. Such dulled blades will usually have significant useful life as a thread cutter. But consumer use of a circular blade as a thread cutter requires a safe and efficient blade holder. The disclosed embodiments a base or base assembly 120 that may act as both a container and holder for a blade cover wherein a blade cover or blade cover assembly 143 may comprise a male holder 130 and a female blade holder 140. The male holder 130 may define a plurality of voids 135 that comport to voids 145 defined within the female holder 140, with such voids allowing for the cutting of thread while limiting the blade exposure to the hands of the user.

3 Claims, 4 Drawing Sheets

BLADE SAVER

CROSS-REFERENCE TO RELATED APPLICATIONS

This utility application claims the benefit and priority date of provisional patent application 62/794,919 filed on Jan. 21, 2019, the contents of which are incorporated herein be referenced as if restated herein.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION

(1) Field of the Invention

The invention generally relates to cutting systems. More particularly, the invention relates to means and methods of creating a new device for reusing a circular blade, wherein the circular blade may have been dulled from fabric cutting, allowing the circular blade to be repurposed to cut thread.

(2) Description of the Related Art

The known related art fails to anticipate or disclose the principles of the present invention.

In the related art, circular blades are known and are sometimes used for cutting foodstuffs such as pizza and are sometimes known for cutting fabric. In cutting fabric, round or circular blades will become dull and are usually discarded. A circular blade dulled from fabric cutting will have some sharpness left for cutting other materials, but the prior art lacks any means of repurposing such blades. Often, those who are cutting fabric have a need to cut thread. The prior art fails to leverage this factor.

Thus, there is a need in the art for the present invention.

BRIEF SUMMARY OF THE INVENTION

The present invention overcomes shortfalls in the related art by presenting an unobvious and unique combination and configuration of methods and components to create a new holder for housing a dulled circular blade to facilitate the cutting of thread and other materials. Disclosed embodiments may be called a "Blade Saver."

A disclosed embodiment or blade saver may comprise a plurality of assemblies and parts. A disclosed base or base assembly is comprised of an upper and lower piece. The base may store a blade cover or blade cover assembly with the blade cover comprising a male bade holder and a female blade holder, with the two holders attached by use of a barrel nut and a centrally disposed void within each holder. The blade cover may house a rotary cutter blade with the blade cover having voids allowing for thread and other objects to be cut upon exposed portions of the blade. The blade cover protects the hands of the user while providing several access voids for cutting. The blade cover may be stored within the base. During use, the blade cover may secured within a void defined within the base. The blade may remain stationary within the blade cover.

These and other objects and advantages will be made apparent when considering the following detailed specification when taken in conjunction with the drawings.

REFERENCE NUMERALS IN THE DRAWINGS

100 a disclosed blade saver

110 lower base piece

115 upper base piece

Figure 1:
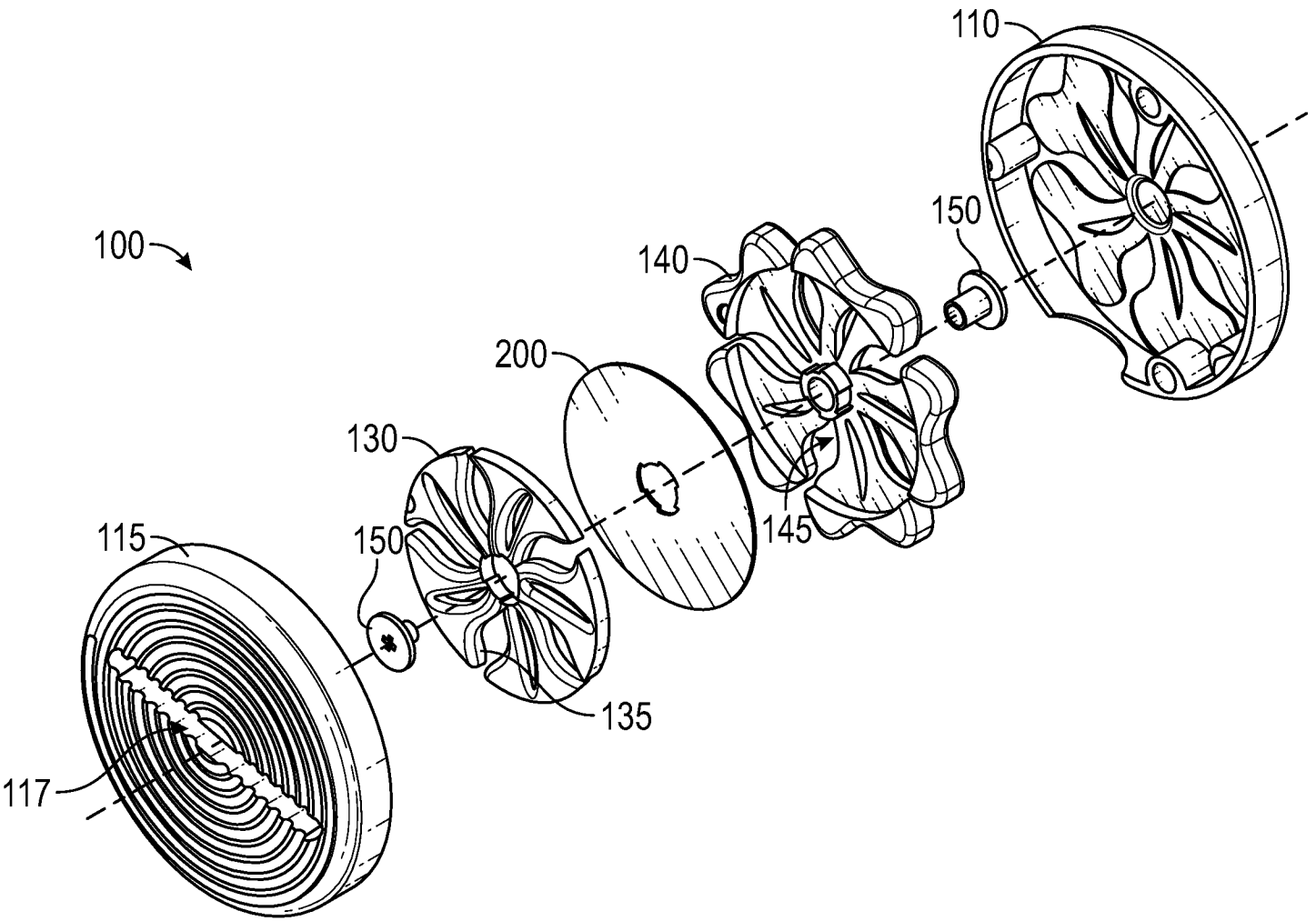
FIG. 1 depicts an exploded view of a disclosed embodiment

117 top void defined within upper base piece

120 base assembly comprising a lower base piece 110 and upper base piece 115

130 male blade holder

135 cutting voids defined within the male blade holder 130

140 female blade holder

143 blade holder assembly comprising a male blade holder 130 and female blade holder 140

145 cutting voids defined within the female blade holder 140

150 Chicago nut or barrel bolt

160 side void or opening void defined within the base assembly 120

200 rotary blade

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Figure 4:
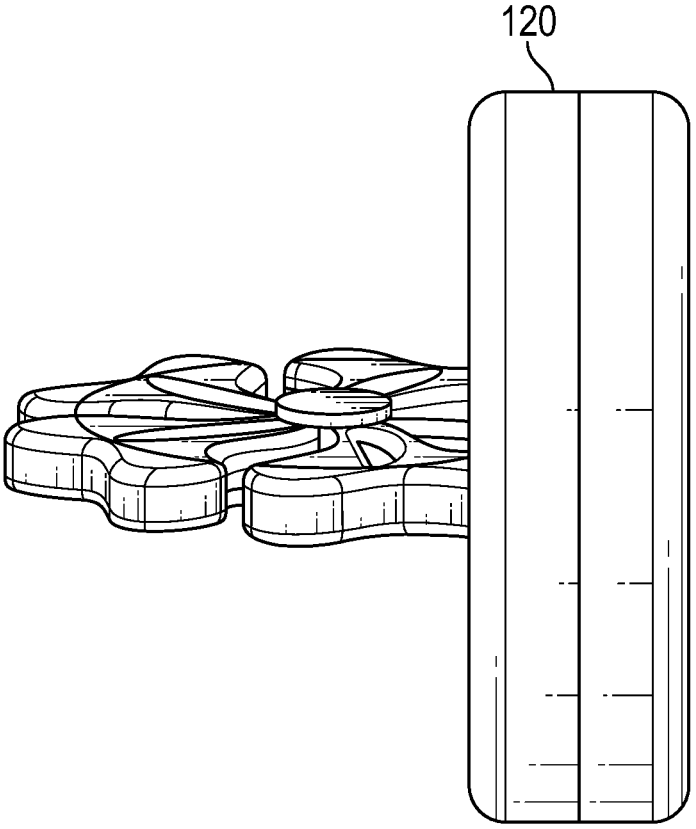
FIG. 4 depicts a side view

FIG. 1 depicts an exploded view of a disclosed blade saver 100 which may comprise a base or base assembly 120, see FIG. 4, the base comprising a lower base piece 110 and an upper base piece 115. The base may act as both a container and holder for a blade cover wherein a blade cover or blade cover assembly may comprise a male holder 130 and a female blade holder 140. The male holder 130 may define a plurality of voids 135 that comport to voids 145 defined within the female holder 140, with such voids allowing for the cutting of thread while limiting the blade exposure to the hands of the user. A rotary blade 200 may be disposed between the male blade holder 130 and the female blade holder 140.

A barrel bolt 150 or Chicago nut may be used to secure the rotary blade between the male and female blade holders.

Figure 2:
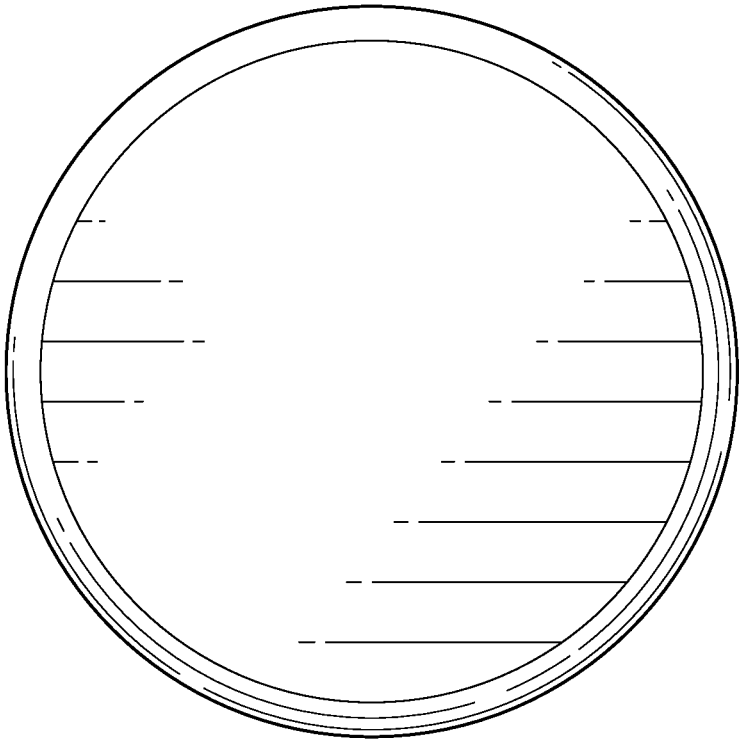
FIG. 2 depicts a bottom view

FIG. 2 depicts a bottom view of a lower base piece 110.

Figure 3:
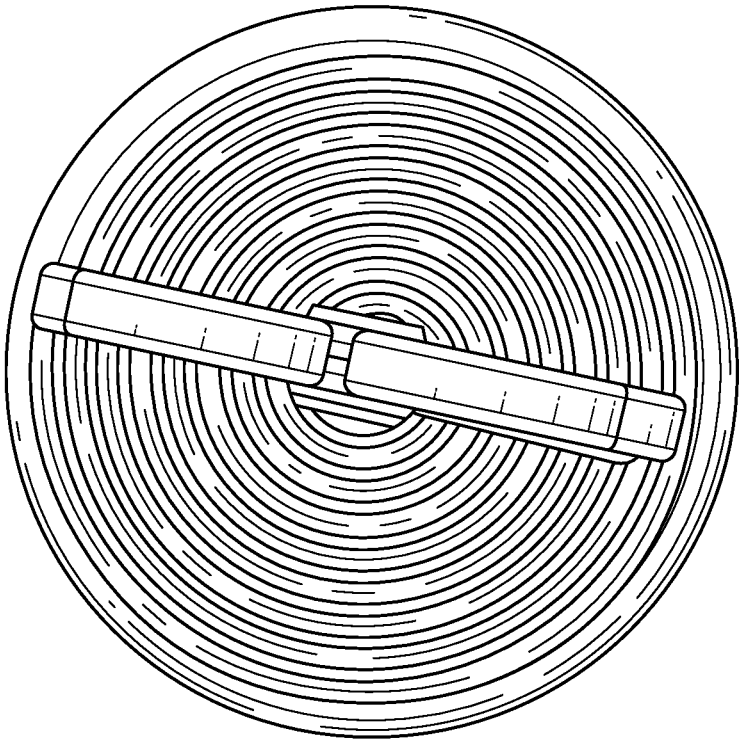
FIG. 3 depicts a top view

FIG. 3 depicts a top view of a base assembly, the base assembly comprising a upper base piece as shown, and the base assembly used to secure and hold upright a blade holder assembly 143. The disclosed embodiments overcome shortfalls in the related art by providing both a storage system, holder system for a blade holder assembly and means to project hands from being cut while using a circular blade.

Moreover, thread and other fabric related materials may be cut with the blade holder assembly secured within the base assembly. With the blade holder assembly supported and held upright by the base assembly, a user may have both hand free to place thread or other items within the voids of the blade assembly allowing the repurposed blade to be used. Thus, the disclosed embodiments present both a hands free cutting system, storage system and safe blade holding system.

FIG. 4 depicts a perspective view of a disclosed embodiment.

Figure 5:
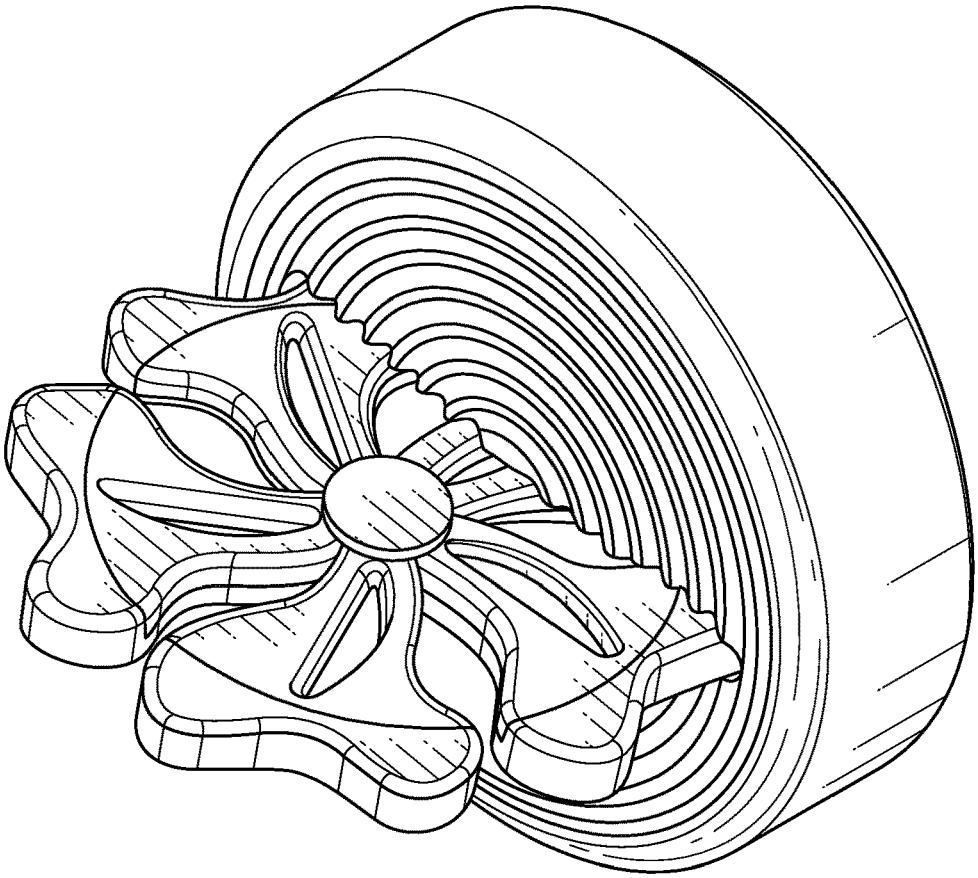
FIG. 5 depicts a perspective view

FIG. 5 depicts another perspective view of a disclosed embodiment.

Figure 6:
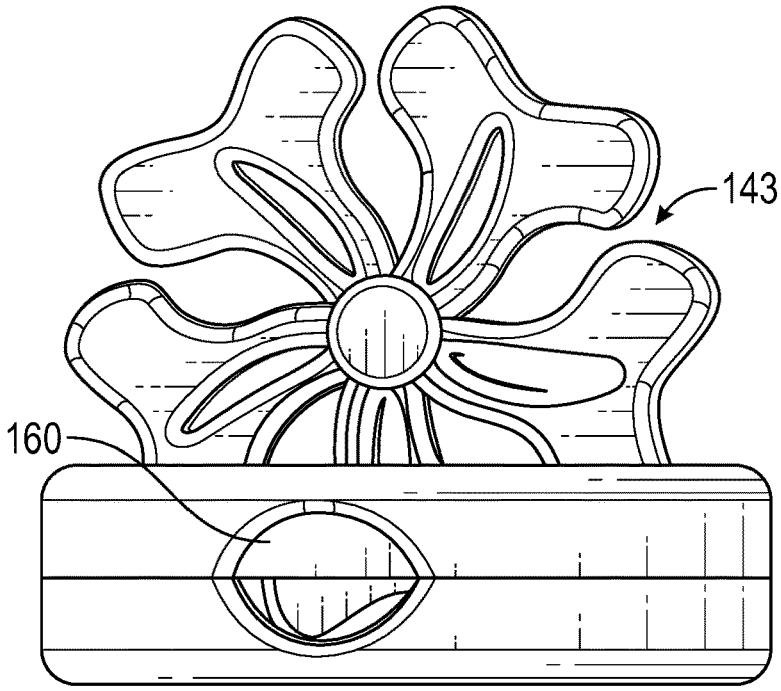
FIG. 6 depicts an elevation view

FIG. 6 depicts an elevational view or side view of a blade holder assembly 143 inserted into a base assembly 120. The base assembly is shown to define an opening 160, with the opening helping the elderly to pull apart the base assembly. The base assembly may be secured together by use of magnets and/or other means.

What is claimed is:

1. A blade holder, blade storage and blade support system, the system comprising:

a) a blade holder assembly (143) comprising a male blade holder (130) and female blade holder (140) with cutting voids defined within the male blade holder and cutting voids defined within the female blade holder;

b) a base assembly (120) comprising a lower base piece (110) and an upper base piece (115) with the upper base piece and lower base piece defining a side void (160) and the upper base piece defining a top void (117), the top void comporting to retain the blade holder assembly in vertical position; and c) the base assembly having interior portions configured store the blade holder assembly.

2. The system of claim 1 wherein the male blade holder and female blade holder define a centrally disposed void configured to accept a fastener, with the fastener attaching the male blade holder the female blade holder.

3. The system of claim 2 wherein a rotary blade is secured between the male blade holder and female blade holder.

* * * * *